US007008253B2

(12) United States Patent
Szczesny

(10) Patent No.: US 7,008,253 B2
(45) Date of Patent: Mar. 7, 2006

(54) ELECTRICAL CONNECTOR HAVING LATCH ACTUATING MECHANISM

(75) Inventor: David Stanley Szczesny, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/846,471

(22) Filed: May 14, 2004

(65) Prior Publication Data

US 2005/0255736 A1 Nov. 17, 2005

(51) Int. Cl.
*H01R 13/627* (2006.01)

(52) U.S. Cl. ..... 439/352

(58) Field of Classification Search ..... 439/352, 439/357, 358, 258, 180, 354
See application file for complete search history.

(56) References Cited

U.S. PATENT DOCUMENTS 3,634,732 A * 1/1972 Finger et al. ..... 361/726
5,199,897 A 4/1993 Hashiguchi
5,529,512 A 6/1996 Mlyniec
5,580,268 A 12/1996 Miyazawa
6,165,006 A * 12/2000 Yeh et al. ..... 439/490
6,347,954 B1 * 2/2002 Jones et al. ..... 439/358
6,447,170 B1 * 9/2002 Takahashi et al. ..... 385/53
6,739,904 B1 * 5/2004 Wu ..... 439/497
6,866,533 B1 3/2005 Wu ..... 439/352

* cited by examiner

*Primary Examiner*—Chandrika Prasad

(57) ABSTRACT

An electrical connector that includes a housing having an interconnect end and a rear end, and a wall containing a channel extending at least partially between the interconnect and rear ends. A latch is held by the housing, and a lanyard actuates the latch. The lanyard has a beam slidably provided within the channel. Travel limits are provided on the beam and within the channel. The travel limits cooperate with one another to define a range of motion over which the lanyard moves within the channel. One of the lanyard and the channel has a compliant portion flexing to permit the beam to be loaded through an end of the channel until the travel limits engage one another.

22 Claims, 8 Drawing Sheets

ELECTRICAL CONNECTOR HAVING LATCH ACTUATING MECHANISM

BACKGROUND OF THE INVENTION

This invention relates generally to electrical connectors, and more particularly, to an electrical connector having a latch actuating mechanism.

Numerous electrical connectors and receptacles exist that mate through an interface and that lock together when the electrical connector is inserted into the receptacle. Generally, a latch, including a hook portion, is provided for locking the electrical connector to the receptacle via locking features extending from the receptacle. When the electrical connector is mated with the receptacle, the hook portions engage the respective locking features and the electrical connector is locked thereon. In order to release the locked electrical connector from the receptacle, the latches are manually operated to open the hook portions, and then the electrical connector can be longitudinally moved to disconnect from the receptacle. To quickly release the locked electrical connector from the receptacle, some known electrical connectors include an actuating mechanism that extends from the electrical connector and is pulled in a direction generally opposite the receptacle to release the hook portions.

Several known electrical connectors are configured to electrically couple to a cable at the rear end of the connector. An overmold and a molded strain relief join directly to the cable. The overmold adheres to an external surface of the cable and reinforces the cable strain relief.

However, known electrical connectors are assembled with the actuating mechanism pre-loaded within the housing of the electrical connectors prior to coupling the cable to the housing. Therefore, the cable, the strain relief, and the overmolding are assembled and attached to the electrical connector while the actuating mechanism is present. Consequently, additional time was needed to manufacture the electrical connectors. Preloading the actuating mechanism also made manufacture more difficult, increased the potential for manufacturing error, and added expense.

BRIEF DESCRIPTION OF THE INVENTION

In an exemplary embodiment of the present invention, an electrical connector is provided that includes a housing having an interconnect end and a rear end, and a wall containing a channel extending at least partially between the interconnect and rear ends. A latch is held by the housing, and a lanyard actuates the latch. The lanyard has a beam slidably provided within the channel. Travel limits are provided on the beam and within the channel. The travel limits cooperate with one another to define a range of motion over which the lanyard moves within the channel. One of the lanyard and the channel may have a compliant portion flexing to permit the beam to be loaded through an end of the channel until the travel limits engage one another.

In another exemplary embodiment of the present invention, an electrical connector is provided that includes a housing having an interconnect end and a rear end, and a wall having a channel extending at least partially between the interconnect and rear ends. The channel defines a latch retention plane, and a latch member is provided in the channel. The latch member has a pivot section rotatably held in the channel, a latch section configured to engage a mating connector and a ramp section deflecting the latch section about the pivot section inward toward the housing. A lanyard actuates the latch member.

In a further exemplary embodiment of the present invention, an electrical connector is provided that includes a housing having an interconnect end and a rear end, and a wall having a channel extending at least partially between the interconnect and rear ends. A latch member is provided in the channel. The latch member has a pivot section rotatably held in the channel, a latch section configured to engage a mating connector and a ramp section deflecting the latch section about the pivot section inward toward the housing. A lanyard actuates the latch member. The lanyard has a beam slidably provided within said channel between a neutral position and an unlocked position.

DETAILED DESCRIPTION OF THE INVENTION

Figure 1:
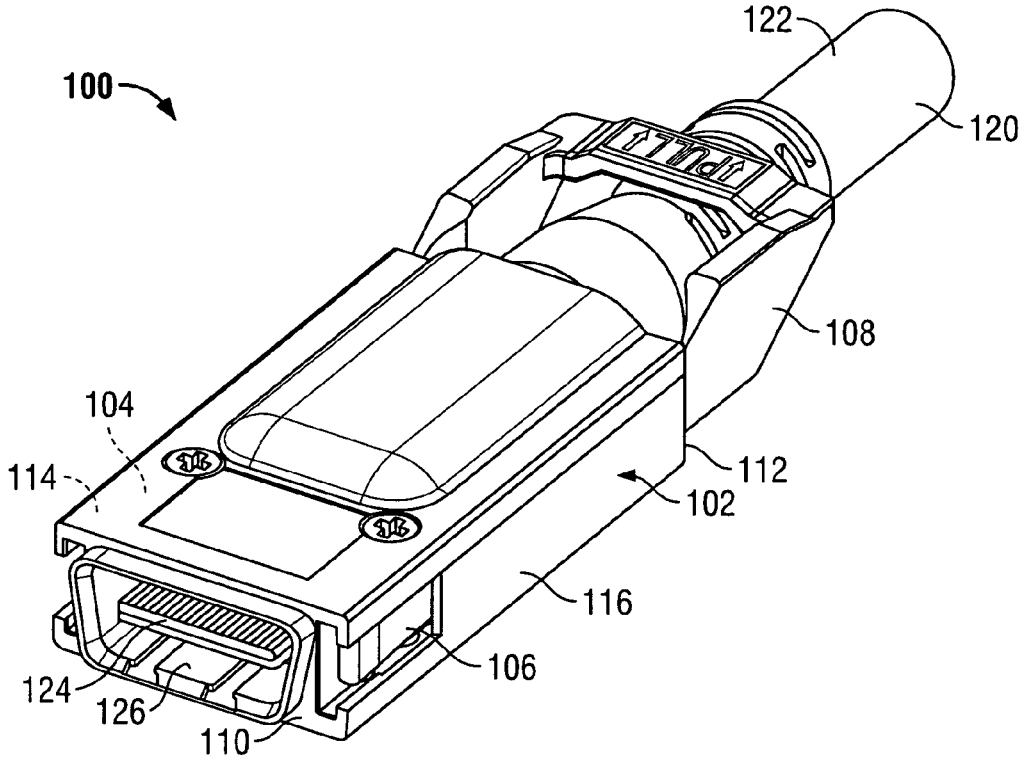
FIG. 1 illustrates an isometric view of an electrical connector formed in accordance with an embodiment of the present invention.
Figure 2:
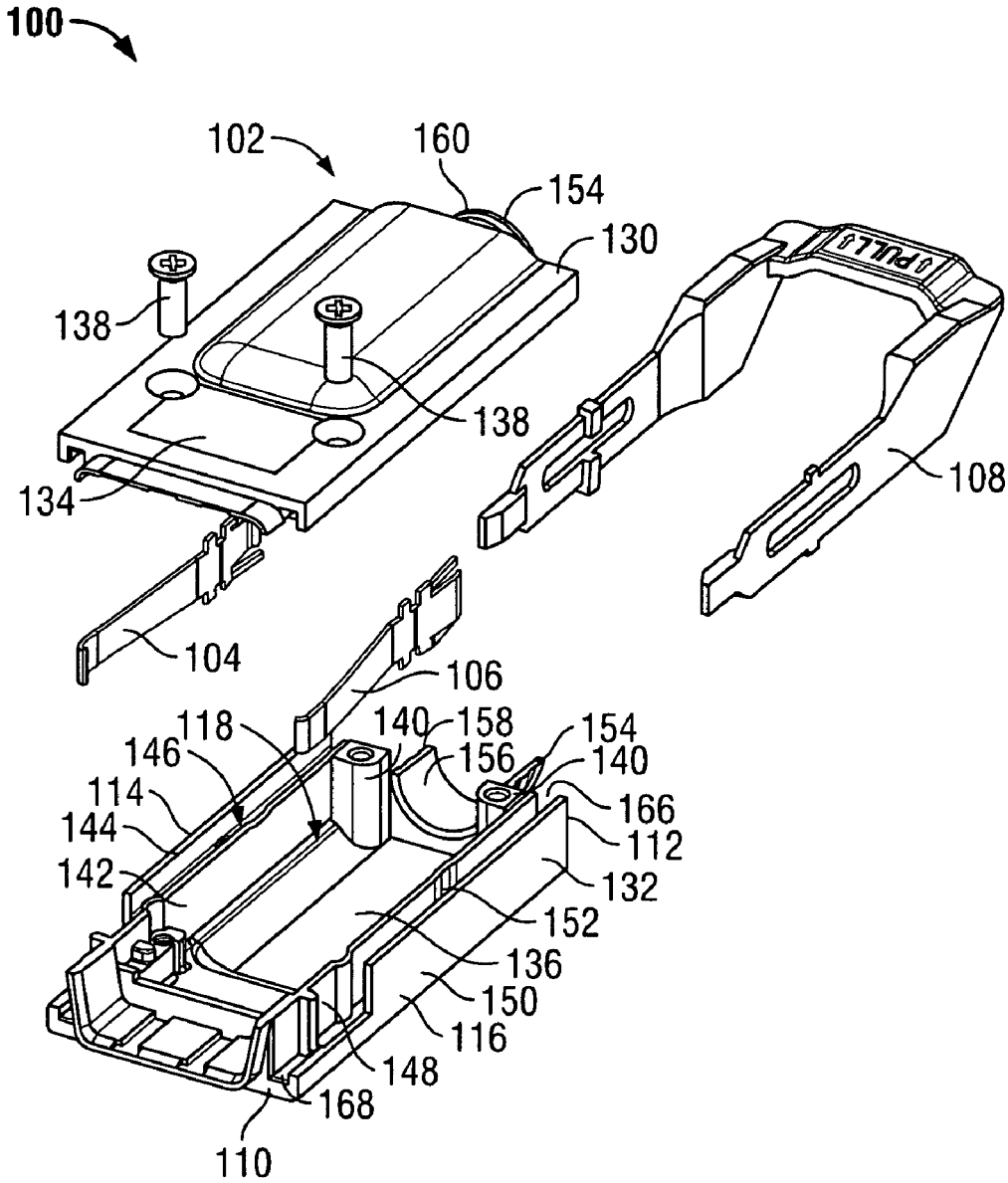
FIG. 2 illustrates an exploded isometric view of the electrical connector of FIG. 1.

FIG. 1 illustrates an isometric view of an electrical connector 100 formed in accordance with an embodiment of the present invention. The electrical connector 100 includes a housing 102, latches 104 and 106 for coupling the electrical connector 100 to a receptacle or mating connector (not shown), and a lanyard 108 for actuating the latches 104 and 106. The housing 102 has a generally box-shaped form that is defined by an interconnect end 110, a rear end 112, and side walls 114 and 116 extending therebetween. The interconnect and rear ends 110 and 112 and the side walls 114 and 116 define a cavity 118 therein (FIG. 2). A cable 120 including an insulating cover 122 covering a plurality of cable wires (not shown) is coupled to the rear end 112 of the housing 102 via a ferrule, or strain relief, 123 and the cable wires extend at least partially into the cavity 118. The cable 120 is electrically connected to an interface component, such as a printed circuit board 124, that interfaces with the receptacle (not shown). In an exemplary embodiment, the interconnect end 110 includes an interconnect cavity 126 and the printed circuit board 124 extends at least partially within the interconnect cavity 126. The interconnect cavity 126 is oriented to allow the printed circuit board 124 to interface with the receptacle.

FIG. 2 illustrates an exploded isometric view of the electrical connector 100 showing the latches 104 and 106 and the lanyard 108. As shown in FIG. 2, the housing 102 includes a top shell 130, or cover, and a bottom shell 132.

The top shell 130 includes a top surface 134 that extends between the side walls 114 and 116 and the interconnect and rear ends 110 and 112. The bottom shell 132 includes a bottom surface 136 that extends between the side walls 114 and 116 and the interconnect and rear ends 110 and 112. In an exemplary embodiment, the shells 130 and 132 are fabricated from a conductive material, such as, but not limited to, a metal material, and are cast into the generally box-shaped form shown in FIG. 1. The top and bottom shells 130 and 132 have a substantially similar footprint such that the top shell 130 is placed directly over the bottom shell 132 prior to being coupled together via a plurality of fasteners 138, such as, by way of example only, screws. In an exemplary embodiment, a plurality of support columns 140 are positioned within the cavity 118 of the housing 102 to provide support for the top shell 130 when positioned upon the bottom shell 132.

When the top and bottom shells 130 and 132 are coupled together, the side walls 114 and 116 associated with the top and bottom shells 130 and 132 are substantially aligned and extend from the rear end 112 to the interconnect end 110 of the housing 102. The side wall 114 includes an inner side wall 142, a parallel outer side wall 144, and a channel 146 extending therebetween along a latch retention plane 366. The side wall 116 includes an inner side wall 148, an outer side wall 150, and a channel 152 extending therebetween along a latch retention plane 367. In an exemplary embodiment, the latches 104 and 106 and the lanyard 108 are contained within the channels 146 and 152. The side walls 114 and 116 each include a lanyard opening 166 located at the rear end 112 and a receptacle opening 168 located at the interconnect end 110. The lanyard and receptacle openings 166 and 168 allow access to the channels 146 and 152.

A protrusion 154 extends from the rear end 112 of the housing 102. The protrusion 154 includes a plurality of grooves 160 extending circumferentially around the protrusion 154. The cable 120 (FIG. 1) is coupled to the protrusion 154 and is secured thereto via the strain relief 123 being crimped around the insulating cover 122 and the grooves 160. The wires in the cable 120 extend through the protrusion 154 into the cavity 118 of the housing 102 and are electrically coupled to the printed circuit board 124 (FIG. 1).

Figure 3:
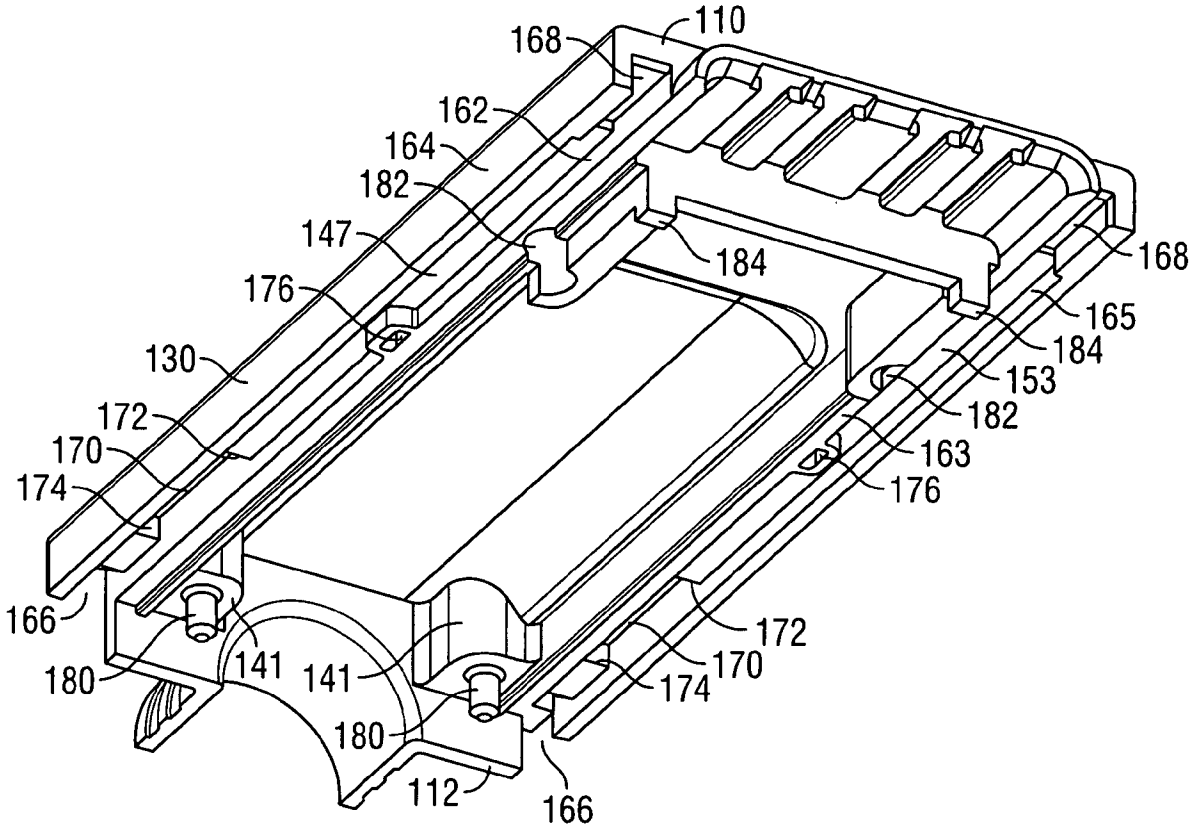
FIG. 3 illustrates a bottom isometric view of a portion of the electrical connector of FIGS. 1 and 2.

FIG. 3 illustrates a bottom isometric view of the top shell 130 of the housing 102. The top shell 130 includes channels 147 and 153 formed within side walls 114 and 116, respectively, between inner side walls 162 and 163, and outer side walls 164 and 165, respectively. The channels 147 and 153 each include an upper travel slot 170 extending between a forward end 172 and a rearward end 174 of the upper travel slot 170. In an exemplary embodiment, the upper travel slots 170 are positioned within the channels 147 and 153 proximate to the rear end 112 of the housing 102. The upper travel slot 170 constitutes a travel limit to define a range of motion over which the lanyard 108 moves within the channels 147 and 153. Each channel 147 and 153 also includes an upper pivot post opening 176. The upper pivot post openings 176 are positioned within the channels 147 and 153 between the respective upper travel slots 170 and the interconnect end 110 of the housing 102. In an exemplary embodiment, the upper pivot post openings 176 are positioned proximate the midpoint of the respective channels 147 and 153.

The top shell 130 includes support columns 141 that align with support columns 140 in the bottom shell 132. The support columns 141 include shell retention tabs 180 extending therefrom. The shell retention tabs 180 align the top and bottom shells 130 and 132 when coupled together, and also prevent translation of the shells 130 and 132 along the mating plane of the shells 130 and 132. In an exemplary embodiment, the top shell 130 also includes a plurality of fastener bores 182 extending through the top shell 130 which allow the fasteners 138 (FIG. 2) to pass through the top shell 130 and couple the top shell 130 to the bottom shell 132. The top shell 130 further includes a plurality of alignment features 184 that align and position the printed circuit board 124 (FIG. 1) for connection to the receptacle (not shown).

Figure 4:
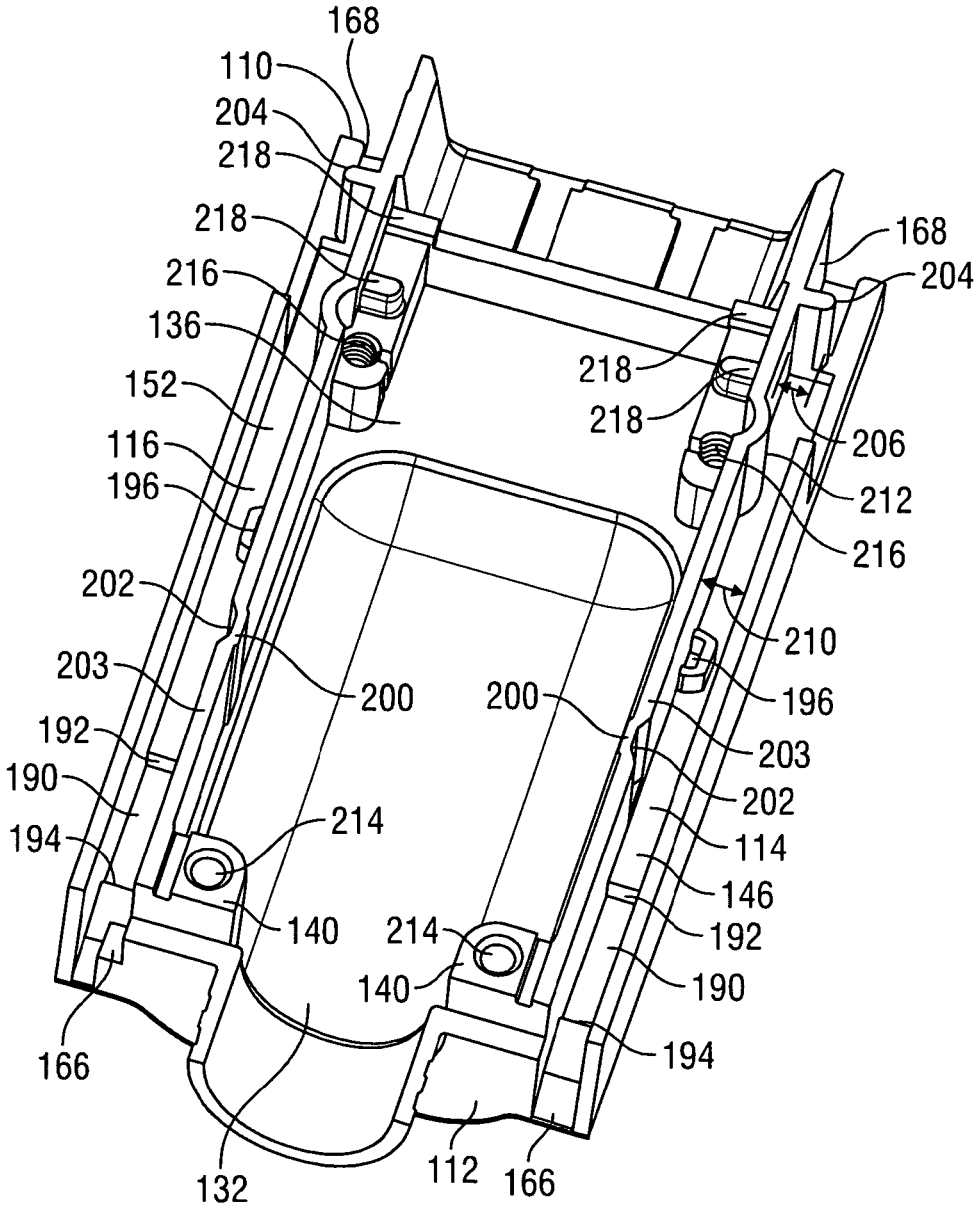
FIG. 4 illustrates a top isometric view of a portion of the electrical connector of FIGS. 1 and 2.

FIG. 4 illustrates a top isometric view of the bottom shell 132 including the support columns 140. The support columns 140 include shell retention bores 214 extending therein that are aligned with the shell retention tabs 180 extending from the upper support members 141 in the top shell 130. The shell retention bores and tabs 214 and 180 align the top and bottom shells 130 and 132 when coupled together and prevent translation along a mating plane. The bottom shell 132 also includes a plurality of fastener bores 216 extending from the bottom surface 136 of the bottom shell 132. The fastener bores 216 accept the fasteners 138 (FIG. 2) such that the top shell 130 and the bottom shell 132 are fixedly coupled to one another. The bottom shell 132 further includes a plurality of alignment features 218 that align and position the printed circuit board 124 (FIG. 1) for connection to the receptacle. The bottom shell further includes the lanyard and receptacle openings 166 and 168, respectively, located at the rear and interconnect ends 112 and 110, respectively. The lanyard and receptacle openings 166 and 168 allow access to the channels 146 and 152.

The channels 146 and 152 each include a lower travel slot 190 that constitutes a travel limit to define a range of motion over which the lanyard 108 moves within the channels 146 and 152. Each lower travel slot 190 has a forward end 192 and a rearward end 194. The lower travel slots 190 are positioned within the channels 146 and 152 proximate to the rear end 112 of the housing 102. Furthermore, in an exemplary embodiment, the lower travel slots 190 are substantially oriented and aligned with the upper travel slots 170 in the top shell 130 (FIG. 3). Optionally, the lower travel slots 190 may be oriented off set with respect to the upper travel slots 170. Optionally, the upper travel slots 170 or the lower travel slots 190 may be entirely removed, or more than one travel slot 170 and/or 190 may be provided in each channel 146, 147, 152, and 153.

The channels 146 and 152 also include lower pivot post openings 196 that are positioned between the lower travel slot 190 and the interconnect end 110 of the channel 146 or 152. The lower pivot post openings 196 are substantially oriented and aligned with the upper pivot post openings 176. The upper and lower pivot post openings 196 and 176 rotatably hold the latches 104 and 106 in the channels 146, 147 152, and 153. Optionally, either the upper pivot post openings 176 or the lower pivot post openings 196 may be entirely removed.

Notched out portions 200 are provided in the inner side walls 142 and 148, respectively, such that a recess 202 is formed within an exterior 203 of the inner side walls 142 or 148. The notched out portion 200 of each inner side wall 142 or 148 is positioned between the lower travel slots 190 and the lower pivot post openings 196. Each recess 202 receives and holds an end of each of the latches 104 and 106 to allow for additional rotational movement of the end of the respective latches 104 and 106 and resist linear motion of the latches 104 and 106 along the channels 146 and 152, respectively. Optionally, the notched out portions 200 may be removed entirely or may be provided in an interior surface of the outer side walls 144 and 150.

Rounded ribs 204 or stops extend outwardly from the inner side walls 142 and 148 for a distance 206. The distance 206 is selected to be smaller than a width 210 of the channels 146 and 152. The ribs 204 are located proximate the receptacle openings 168. The ribs 204 limit inward lateral travel of the latches 104 and 106.

Figure 5:
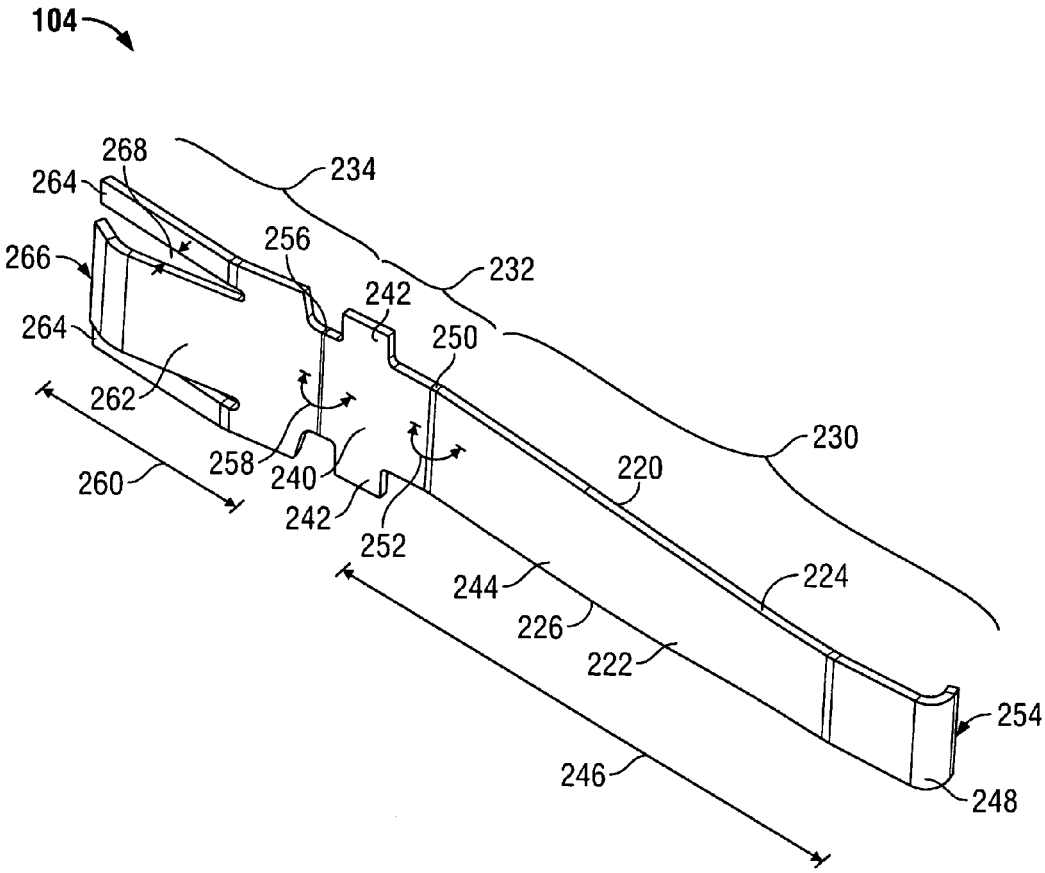
FIG. 5 illustrates an isometric view of a latch for use with the electrical connector of FIGS. 1 and 2.

FIG. 5 illustrates an isometric view of latch 104. While the latch shown in FIG. 5 is described and illustrated in the context of the latch 104, it is recognized that the latches 104 and 106 are substantially similar. The latch 104 has an inner surface 220 and an outer surface 222 extending between a top edge 224 and a bottom edge 226. The latch 104 includes an integrally formed latch section 230, pivot section 232, and ramp section 234. The pivot section 232 is positioned between the latch section 230 and the ramp section 234, such that, when assembled, the ramp section 234 is located proximate the rear end 112 of the housing 102, and the latch section 230 is located proximate the interconnect end 110.

The pivot section 232 includes a pivot base 240 and a pair of pivot posts 242 extending transversely in opposite directions from the pivot base 240 beyond the top edge 224 and the bottom edge 226 of the latch 104. The pivot posts 242 retain the latch 104 in position relative to the housing 102 once the pivot posts 242 are positioned in the upper and lower pivot post openings 176 and 196 (FIGS. 3 and 4) in the channels 146 and 152. Optionally, only one pivot post 242 may be used on only one of the top edge 224 or the bottom edge 226 of the latch 104.

The latch section 230 includes a beam 244 that extends from the pivot section 232 for a distance 246 to a front end 248 of the of the latch 104. The beam 244 extends from the pivot section 232 at a bend 250 such that an obtuse angle 252 is formed between the outer surfaces 222 of the pivot section 232 and the latch section 230. A hook 254 is provided at the front end 248 of the latch 104 for engaging or mating with the receptacle. In an exemplary embodiment, the hook 254 is curved inward toward the inner surface 220 of the latch 104. In an alternative embodiment, the latch section 230 is flat for the distance 246 to the front end 248, and a retention opening (not shown) is provided proximate to the front end 248 such that a locking feature (not shown) of the receptacle can be inserted into the retention opening to secure the electrical connector 100 to the receptacle.

The ramp section 234 extends from the pivot section 232 at a bend 256 such that an obtuse angle 258 is formed between the outer surfaces 222 of the pivot section 232 and the ramp section 234. The ramp section 234 extends from the pivot section 232 for a distance 260 and includes a ramped base 262 extending between a pair of legs 264 extending transversely in opposite directions from the top edge 224 and the bottom edge 226 of the latch 104. The ramped base 262 has a tail end 266 that curves inward toward the inner surface 220 of the latch 104. The ramped base 262 and the legs 264 flare transversely from one another at an acute angle 268. In an exemplary embodiment, the legs 264 contact the inner side wall 142 or 148 and provide a normal deflection force upon the sections 230 and/or 232 and/or 234 of the latches 104 or 106. In use, the ramped section 234 deflects the latch section 230 about the pivot section 232 inward toward the housing 102.

Figure 6:
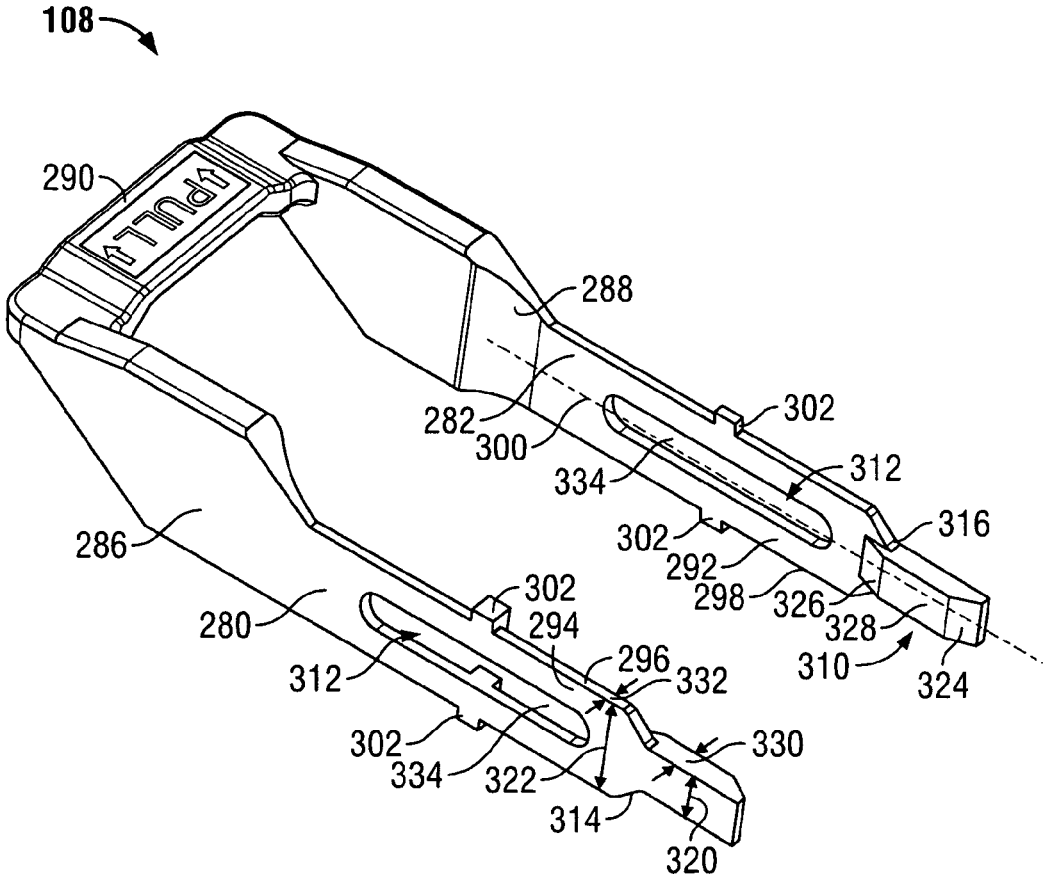
FIG. 6 illustrates an isometric view of a lanyard for use with the electrical connector of FIGS. 1 and 2.

FIG. 6 illustrates an isometric view of the lanyard 108 that may be used with an electrical connector, such as the electrical connector 100. The lanyard 108 includes beams 280 and 282 joined with extension members 286 and 288, and an interconnect member 290 extending between the extension members 286 and 288. The interconnect member 290 extends between the extension members 286 and 288 and spaces the extension members 286 and 288 and beams 280 and 282 apart from one another so that the beams 280 and 282 align with channels 146 and 152.

Each beam 280 and 282 has an inner surface 292, an outer surface 294, a top edge 296, and a bottom edge 298 that extend along a longitudinal axis 300. Each beam 280 and 282 also includes travel limit pins 302 that constitute travel limits when held in the upper and lower travel limit slots 170 and 190. The travel limit pins 302 extend transversely in opposite directions from the top and bottom edges 296 and 298 of the beams 280 and 282. In an alternative embodiment, the travel limit pins 302 may extend from the beams 280 and 282 off set from one another. In another alternative embodiment, only one travel limit pin 302 may be used on either the top edge 296 or the bottom edge 298 of the beams 280 and 282.

The beams 280 and 282 include a latch contact portion 310 and a compliant portion 312. The latch contact portion 310 is positioned at a forward end 314 and 316 of the respective beams 280 and 282 and has a low profile such that the latch contact portion 310 has a height 320 that is shorter than a height 322 of the remaining portions of the beams 280 and 282. The low profile height 320 allows the lanyard 108 to interface with the latches 104 and 106 as the lanyard 108 is moved between the neutral and the unlocked positions, as will be discussed in detail below. The low profile height 320 also acts as a keying feature as the beams 280 and 282 are inserted into the lanyard openings 266 (FIG. 2). The latch contact portion 310 has a front chamfer 324 and a rear chamfer 326 so that a center portion 328 of the latch contact portion 310 has a thickness 330 that is greater than a thickness 332 of the remaining portions of the beams 280 and 282. The front and rear chamfers 324 and 326 allow relative movement of the lanyard 108 with respect to the latches 104 and 106. In an alternative embodiment, the latch contact portion 310 may have a height and/or thickness 320 and/or 330 that is equal to the height and/or thickness 322 and/or 332 of the remaining portions of the beams 280 and 282. In another alternative embodiment, the latch contact portion 310 has a height 320 that is greater than the height 322 of the remaining portions of the beams 280 and 282. In a further alternative embodiment, the latch contact portion 310 has a thickness 330 that is less than the thickness 332 of the remaining portions of the beams 280 and 282.

The compliant portion 312 of each beam 280 and 282 includes a relief opening 334 along the longitudinal axis 300. The relief openings 334 are located proximate the travel limit pins 302 such that the beams 280 and 282 can be deformed inward into the relief openings 334 to allow the beams 280 and 282, including the travel limit pins 302, to enter and pass along the channels 146 and 152 to the upper and lower travel limit slots 170 and 190. The beams 280 and 282 are fabricated from a material such as, but in no way limited to, a rhodia-technyl unfilled nylon material, such that the beams 280 and 282 are capable of flexing but are rigid enough to return to and maintain an initial form in a resting position.

Figure 7:
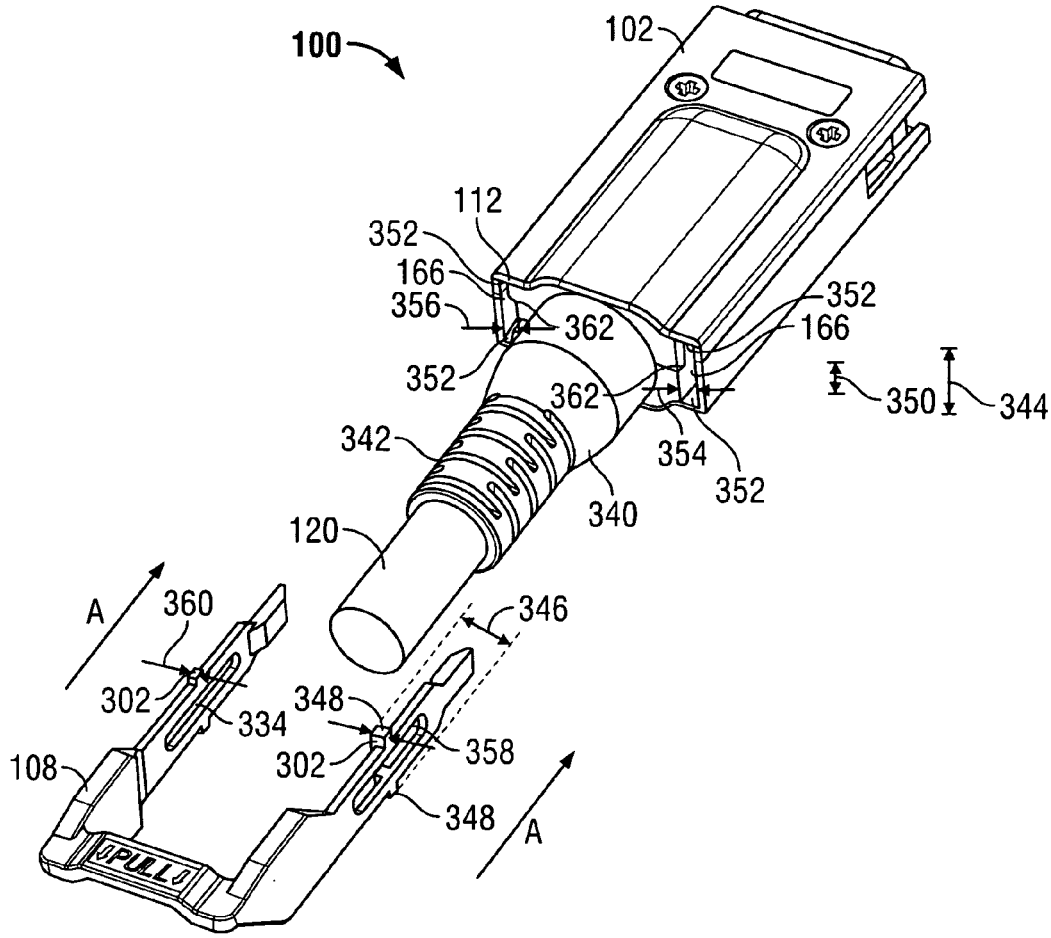
FIG. 7 illustrates an isometric view of the lanyard of FIG. 6 prior to being installed into the electrical connector of FIGS. 1 and 2.

FIG. 7 illustrates an isometric view of the lanyard 108 prior to being installed into the electrical connector 100. The cable 120 is coupled to the rear end 112 of the housing 102 prior to installing the lanyard 108 which allows for an easier and quicker assembly and attachment of the cable 120 and the housing 102. Specifically, once the cable 120 is extended up to the protrusion 154 (FIG. 2), the strain relief 123 is positioned around the cable 120 and the protrusion 154 to secure the cable 120 to the housing 102, and an overmold 342 is then secured to the cable 120 and the strain relief 123.

In one embodiment, a shielding braid (not shown) is extended over the protrusion 154 prior to the strain relief 123 being secured to the cable 120 and the protrusion 154. Once the cable 120 and housing 102 attachment is completed, the lanyard 108 is inserted into the housing 102 in the direction of arrow A.

The lanyard openings 166 are positioned in the rear end 112 of the housing 102 to accept the beams 280 and 282 of the lanyard 108. The lanyard openings 166 provide access for the beams 280 and 282 to the respective channels 146 and 152 located within the side walls 114 and 116. The lanyard openings 166 have an opening height 344 that is substantially equal to a lanyard envelope 346 that is defined by the distance separating an outer surface 348 of each of the travel limit pins 302. The opening height 344 may be greater than an interior height 350 of the corresponding channel, and a ramped section 352 extends from the lanyard openings 166 to the channels 146 and 152 to provide a smooth transition between the lanyard openings 166 and the channels 146 and 152. In an alternative embodiment, the opening height 344 of the lanyard opening 166 associated with the channel 146 may not equal the opening height 344 of the lanyard opening 166 associated with the channel 152.

In use, as the lanyard 108 is inserted into the housing 102 in the direction of arrow A, the beams 280 and 282 flex to permit the beams to be loaded through the lanyard openings 166. Accordingly, the compliant portion 312 permits the travel limit pins to collapse transversely inward towards one another so that the beams 280 and 282 can be loaded into the channels 146 and 152. Specifically, the travel limit pins 302 are forced closer to one another as the travel limit pins 302 are moved through the ramped sections 352 of the housing 102. Furthermore, the relief opening 334 provides an area for the beams 280 and 282 to compress or deform to allow the travel limit pins 302 to move closer to one another and to pass through the channels 146 and 152. When the travel limit pins 302 are located within the channels 146 and 152, the relief openings 334 are fully compressed. Once the lanyard 108 is further inserted, the travel limit pins 302 engage with the upper and lower travel slots 170 and 190 (FIGS. 3 and 4). Specifically, once the travel limit pins 302 pass the rearward ends 174 and 194 of the upper and lower travel slots 170 and 190, the travel limit pins 302 extend into the upper and lower travel slots 170 and 190, and the beams 280 and 282 return to the resting position. In the resting position, the relief openings 334 are extended so that a gap is formed in the beams 280 and 282 and the travel limit pins 302 are extended outward from the beams 280 and 282 into the upper and lower travel slots 170 and 190. The upper and lower travel slots 170 and 190 define the range of motion of the lanyard 108 such that the travel limit pins 302 are moveable between the opposing forward and rearward ends of the upper and lower travel slots 170 and 190.

As illustrated in FIG. 7, the housing 102 and the lanyard 108 both include keying features to ensure that the lanyard 108 is properly inserted into the housing 102. In an exemplary embodiment, the lanyard opening 166 associated with the channel 146 has an opening width 354, and the lanyard opening 166 associated with the channel 152 has an opening width 356 that is shorter than the opening width 354. In an exemplary embodiment, the travel limit pins 302 associated with the beam 280 have a pin width 358 that is substantially equal to the opening width 354, and the travel limit pins 302 associated with the beam 282 have a pin width 360 that is substantially equal to the opening width 356. Accordingly, the lanyard 108 can only be inserted into the housing 102 in one way. The lanyard openings 166 also include an extension portion 362 to accommodate for the latch contact portion 310 of the beams 280 and 282. In an alternative embodiment, the beam 280 and the beam 282 have different widths to correspond to the different opening widths 354 and 356.

Figure 8:
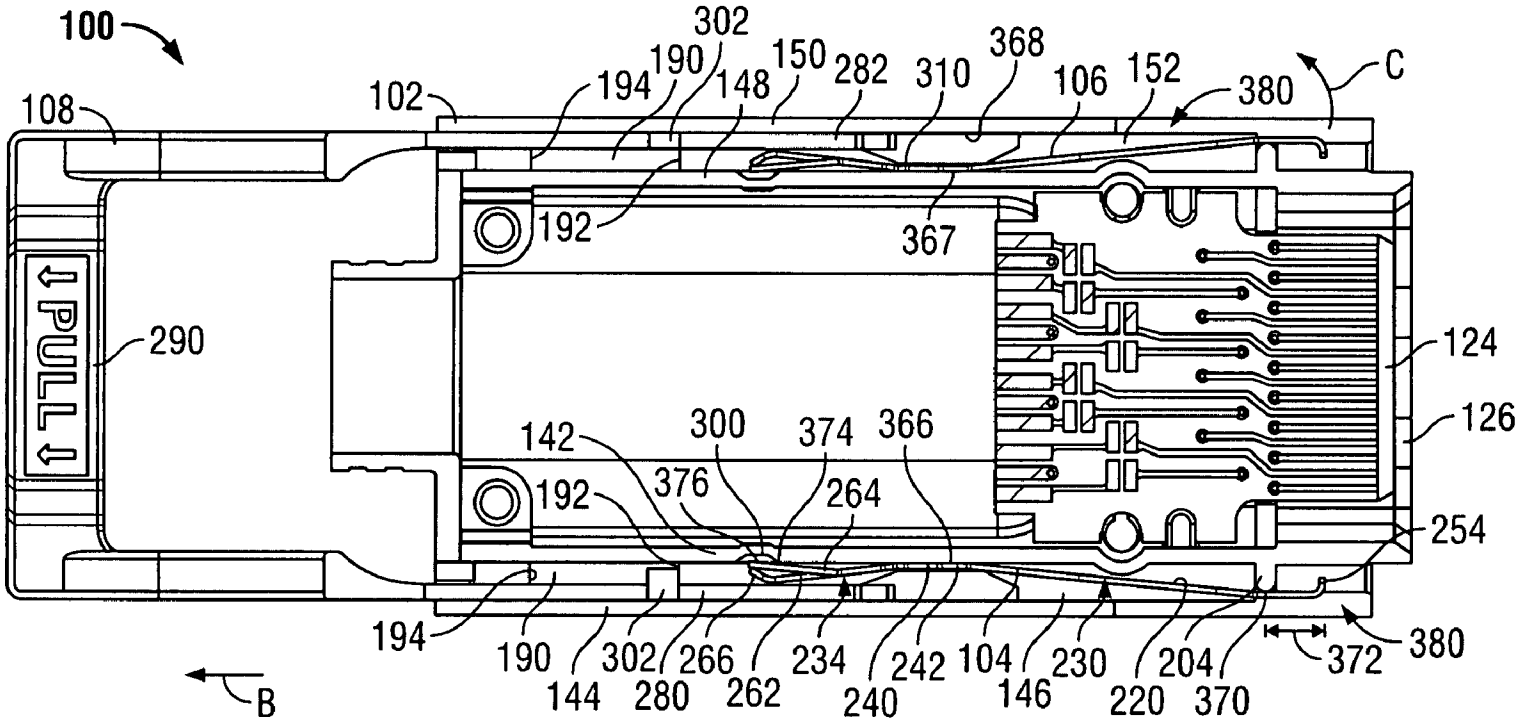
FIG. 8 is a top plan view of the electrical connector of FIGS. 1 and 2.

FIG. 8 is a top plan view of the electrical connector 100 showing the latches 104 and 106 and lanyard 108 in a neutral position. In an exemplary embodiment, the components of the electrical connector 100, namely the latches 104 and 106 and the lanyard 108, are moveable between the neutral, or locked position, and an unlocked position. In the neutral position, the latches 104 and 106 allow the electrical connector 100 to mate with a locking feature (not shown) of the receptacle. Specifically, as the electrical connector 100 is mated with the receptacle, the locking features of the receptacle are moved into the receptacle opening 168 beyond the hooks 254. In the neutral or locked position, the latches 104 and 106 prohibit the electrical connector 100 from being removed from the receptacle as the hooks 254 engage the locking features. However, when the lanyard 108 is pulled in the direction of arrow B, the latches 104 and 106 and the lanyard 108 are transferred to an unlocked position. In the unlocked position, the electrical connector 100 can be unmated or disconnected from the receptacle, as described in detail below.

As shown in FIG. 8, the printed circuit board 124 extends from the cavity 118 of the housing 102 into the interconnect cavity 126 at the interface end 110 of the housing 102. In an exemplary embodiment, the alignment features 218 align and position the printed circuit board 124 for connection with the receptacle. The printed circuit board 124 is also formed around the fastener bores 216 so that the fasteners 138 can extend through the housing 102 and couple the top shell 130 and bottom shell 132. The inner side walls 142 and 148 and the outer side walls 144 and 150 extend the length of the housing 102, with the channels 146 and 152 defined therebetween. Each channel 146 or 152 defines a respective latch retention plane 366 along the inner side walls 142 and 148 and a lanyard beam retention plane 368 along the outer side walls 144 and 150 such that the latches 104 and 106 and the beams 280 and 282 of the lanyard 108 are contained within the channels 146 and 152 at least partially along the respective planes 366, 367 and 368. Specifically, the latch section 230, pivot section 232 and ramp section 234 are oriented generally in-line with the latch retention planes 366 and 367 and are bent to cross the latch retention planes 366 and 367 at multiple lines.

The latches 104 and 106 are positioned within the channels 146 and 152 such that the pivot posts 242 are positioned within the pivot post openings 176 and the pivot bases 240 are positioned adjacent to the respective inner side wall 142 or 148. The pivot bases 240 extend along the respective latch retention plane 366 and 367. The latches 104 and 106 are rotatable from the neutral position to the unlocked position such that the latches 104 and 106 move outward away from the inner side walls 142 and 148, respectively. Moreover, the latches 104 and 106 are rotatable from the unlocked position to the neutral position such that the latches 104 and 106 move inward toward the inner side walls 142 and 148. In an exemplary embodiment, the lanyard 108 actuates the latches 104 and 106 between the neutral and unlocked positions by sliding along the pivot section 232 and the ramp section 234 of the latches 104 and 106.

Each latch section 230 extends outwardly from the inner side wall 142 or 148 and the latch retention planes 366 and 367 so that a portion 370 of the inner surface 220 of the latch 104 or 106 is in abutting contact with the rounded rib 204.

The hook 254 is located a distance 372 from the rounded rib 204 and is curved inwardly toward the inner side wall 142 or 148. The locking features of the receptacle (not shown) are placed between the respective hook 254 and the rounded rib 204 such that the hook 254 retains the locking feature in place until the latch 104 or 106 is moved to the unlocked position.

Each ramp section 234 extends outwardly from the respective inner side wall 142 or 148 and the latch retention planes 366 and 367, and the tail end 266 of the ramped base 262 is curved inwardly toward the inner side wall 142 or 148. In one embodiment, the tail end 266 of the ramped base 262 extends into the recess 202 to allow for additional rotational movement of the ramped base 262 of the latches 104 and 106 and to resist linear motion of the latches 104 and 106 along the channels 146 and 152, respectively. In the neutral position, the legs 264 of the ramp section 234 flare transversely from the ramped base 262 in a direction that is generally toward the inner side wall 142 or 148. A portion 374 of the legs 264 contact the inner side wall 142 or 148 and provide a normal deflection force upon the sections 230 and/or 232 and/or 234 of the latch 104 or 106. A portion 376 of each leg 264 extends through the respective latch retention plane 366 and 367 and extends into the notched out portion 200 of the inner side wall 142 or 148. In the locked position, the tail end 266 of the ramped base 262 extends into the recess 202 to resist linear motion of the latches 104 and 106 along the respective latch retention plane 366 and 367. In an alternative embodiment, the latches 104 and 106 are positioned adjacent the outer side wall 144 or 150.

The lanyard 108 is positioned within the housing 102 such that beams 280 and 282 are slidably provided within the channels 146 and 152. The beams 280 and 282 are positioned adjacent the outer side walls 144 and 150 and extend along the lanyard beam retention plane 368. The lanyard 108 is illustrated in FIG. 8 in the neutral position. In the neutral position, the latch contact portion 310 is positioned adjacent the pivot base 240 and the travel limit pins 302 are positioned adjacent the forward end 172 and 192 of the travel slots 170 and 190. This is the forward most position the lanyard 108 is capable of traveling due to the limited range of motion of the travel limit pins 302. In use, the travel limit pins 302 and the travel slots 170 and 190 cooperate with each other to define the range of motion of the lanyard 108. In an alternative embodiment, the travel limit pins 302 are coupled to the housing 102 within the channels 146 and 152, and the travel slots 190 are positioned within the beams 280 and 282 of the lanyard 108.

The lanyard 108 is moveable from the neutral position to the unlocked position, wherein the lanyard 108, particularly the interconnect member 290, is pulled in the direction of arrow B. In the neutral or locked position, the travel limit pins 302 are positioned adjacent the forward ends 172 and 192 of the travel slots 170 and 190, which defines the forward most position the lanyard 108 is capable of traveling due to the limited range of motion of the travel limit pins 302. In the unlocked position, the travel limit pins 302 are positioned adjacent the rearward ends 174 and 194 of the travel slots 170 and 190, which defines the rearward most position the lanyard 108 is capable of traveling due to the limited range of motion of the travel limit pins 302.

In use, as the lanyard 108 is pulled in the direction of arrow B, the latch contact portion 310 of each beam 280 and 282 slides along the ramp section 234 of the latch 104 or 106, and the lanyard 108 actuates the latches 104 and 106. The low profile height 320 of the latch contact portion 310 allows the latch contact portion 310 to move along the ramped base 262 between the legs 264 of the ramp section 234 so that the legs 264 move independently of the ramped base 262. In the unlocked position, the latch contact portion 310 is adjacent to the tail end 266 of the ramped base 262 and is adjacent to the notched out portion 200 of the inner side wall 142 or 148. The inwardly curved shape of the ramped base 262 is forced into the notched out portion 200. In the unlocked position the normal deflection force imposed on the latch 104 or 106 by the latch contact portions 310 of the lanyard 108 forces the latch 104 or 106 to pivot about the pivot posts 242, and forces the latch section 230 to extend outwardly from the inner side wall 142 or 148. In the locked position, the normal deflection force imposed on the latches 104 and 106 by the legs 264 forces the latches 104 and 106 to pivot about the pivot posts 242 and forces the latch section 230 to be in the neutral or locked position. A latch opening 380 is provided in the outer side walls 144 and 150 so that the latch section 230 can extend outwardly from the inner side wall 142 or 148 along the curvilinear path of travel of arrow C, such that the locking features of the receptacle can pass by the hooks 254. When the latches 104 and 106 are flared outward, the electrical connector 100 can be disconnected from the receptacle. After the electrical connector 100 and the receptacle are disconnected, the lanyard 108 may be returned to the neutral position by moving the lanyard in a direction that is generally opposed to arrow B. In an alternative embodiment, the beams 280 and 282 of the lanyard 108 are positioned along the inner side wall 142 or 148.

In an alternative embodiment, the housing 102 does not include the inner side walls 142 and 148. Rather, the latches 104 and 106 are located adjacent the interior of the outer side walls 144 and 150. The lanyard 108 is inserted into the housing 102 such that, the lanyard 108 provides a retention force upon the latches 104 and 106 to maintain the latches 104 and 106 adjacent the outer side walls 144 and 150. The lanyard 108 is moveable between a neutral position wherein the latches 104 and 106 are capable of retaining the locking features of the receptacle (not shown), and an unlocked position wherein the latches 104 and 106 are flared outward such that the electrical connector 100 and the receptacle may be disconnected from one another.

The above-described electrical connector 100 provides a cost effective and reliable means for manufacturing and assembling electrical connectors 100. Specifically, the electrical connector 100 includes a lanyard 108 that can be loaded or inserted into the housing 102 after the cable 120, strain relief 123, and overmold 342 are attached to the housing 102. Accordingly, the strain relief 123 and the overmolding 342 can be manufactured and attached without the presence of the lanyard 108. As a result, manufacture and assembly of the electrical connector 100 is made easier, and manufacture time, error and cost are all reduced.

Exemplary embodiments of electrical connectors 100 are described above in detail. The electrical connectors 100 are not limited to the specific embodiments described herein, but rather, components of each electrical connector 100 may be utilized independently and separately from other components described herein. For example, each electrical connector 100 component can also be used in combination with other electrical connector 100 components.

While the invention has been described in terms of various specific embodiments, those skilled in the art will recognize that the invention can be practiced with modification within the spirit and scope of the claims.

What is claimed is:

1. An electrical connector, comprising:

a housing having an interconnect end and a rear end, and a wall containing a channel extending at least partially between said interconnect and rear ends;

a latch held by said housing;

a lanyard actuating said latch, said lanyard having a beam slidably provided within said channel; and travel limits provided on said beam and within said channel, said travel limits cooperating with one another to define a range of motion over which said lanyard moves within said channel, one of said lanyard and channel having a compliant portion flexing to permit said beam to be loaded through an end of said channel until said travel limits engage one another.

2. The electrical connector of claim 1, wherein said travel limits include a travel limit pin provided on said beam.

3. The electrical connector of claim 1, wherein said travel limits include a travel slot formed in said channel.

4. The electrical connector of claim 1, wherein said travel limits include a travel slot and a travel limit pin moveable between opposite ends of said travel slot to define said range of motion of said lanyard.

5. The electrical connector of claim 1, wherein said beam extends along a longitudinal axis and has a pair of travel limit pins extending transversely in opposite directions from said longitudinal axis.

6. The electrical connector of claim 1, wherein said compliant portion includes a relief opening through said beam located proximate at least one of said travel limits.

7. The electrical connector of claim 1, wherein said compliant portion includes an elongated relief opening through said beam, wherein a portion of said beam proximate said relief opening partially collapses into said relief opening as said beam is loaded into said channel.

8. The electrical connector of claim 1, wherein said rear end of said housing includes a protrusion configured to receive a cable.

9. The electrical connector of claim 1, wherein said lanyard includes a pair of said beams spaced apart from one another and joined by an interconnect member, said housing including a pair of said channels arranged along opposite sides of said housing, said channels opening onto said rear end, said channels receiving respective ones of said beams.

10. The electrical connector of claim 1, wherein said travel limit on said beam extends transversely outward from said beam to define a lanyard envelope that is greater than an interior height of said channel, said compliant portion permitting said travel limit to collapse transversely inward toward said beam to be loaded into said channel.

11. An electrical connector, comprising:

a housing having an interconnect end and a rear end, and a wall having a channel extending at least partially between said interconnect and rear ends, said channel including a latch retention plane;

a latch member provided in said channel, said latch member having a pivot section rotatably held in said channel, a latch section configured to engage a mating connector and a ramp section deflecting said latch section about said pivot section inward toward said housing; and a lanyard actuating said latch member.

12. The electrical connector of claim 11, wherein said pivot section includes a pair of pivot posts extending transversely in opposite directions, said pivot posts rotatably held by said channel.

13. The electrical connector of claim 11, wherein said latch, pivot and ramp sections are oriented in-line with said latch retention plane and bent to cross said latch retention plane at multiple lines.

14. The electrical connector of claim 11, wherein said pivot section is provided between said latch and ramp sections and said latch and ramp sections are bent at an obtuse angle with respect to one another.

15. The electrical connector of claim 11, wherein said ramp section includes a ramped base provided between legs, said base and legs flaring transversely from one anther to induce a normal deflection force upon said latch section.

16. The electrical connector of claim 11, wherein said lanyard includes a beam with an outer end aligning with and slidable along said pivot and ramp sections of said latch member.

17. The electrical connector of claim 11, wherein said lanyard includes a beam with an outer end, wherein said outer end engaging and deflecting said ramp section to pivot said latch section outward away from said housing to an unlocked position.

18. An electrical connector, comprising:

a housing having an interconnect end and a rear end, and a wall having a channel extending at least partially between said interconnect and rear ends;

a latch provided in said channel, said latch member having a pivot section rotatably held in said channel, a latch section configured to engage a mating connector and a ramp section deflecting said latch section about said pivot section; and a lanyard actuating said latch, said lanyard having a beam slidably provided within said channel between a neutral position and an unlocked position.

19. The electrical connector of claim 18, wherein said latch is rotatable from a neutral position to an unlocked position such that said latch moves outward away from said side wall, and said latch is rotatable from the unlocked position to the neutral position such that said latch moves inward toward said side wall.

20. The electrical connector of claim 18, wherein said beam includes an outer end aligning with and slidable along said pivot and ramp sections of said latch member.

21. The electrical connector of claim 18, wherein said beam includes an outer end, wherein, when said beam is in said neutral position, said outer end engaging said pivot section, said ramp section deflecting said latch section about said pivot section inward toward said housing to a neutral position.

22. The electrical connector of claim 18, wherein said beam includes an outer end, wherein, when said beam is in said unlocked position, said outer end engaging and deflecting said ramp section to pivot said latch section outward away from said housing to an unlocked position.

* * * * *